US012577947B2

(12) United States Patent
Yanus

(10) Patent No.: US 12,577,947 B2
(45) Date of Patent: Mar. 17, 2026

(54) JUNK RING FOR RECIPROCATING PUMP

(71) Applicant: GD Energy Products, LLC, Tulsa, OK (US)

(72) Inventor: James Robert Yanus, Tulsa, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/955,025

(22) Filed: Nov. 21, 2024

(65) Prior Publication Data

US 2025/0327446 A1 Oct. 23, 2025

Related U.S. Application Data

(60) Provisional application No. 63/637,114, filed on Apr. 22, 2024.

(51) Int. Cl.
*F04B 53/16* (2006.01)

(52) U.S. Cl.
CPC ..... *F04B 53/164* (2013.01)

(58) Field of Classification Search
CPC ..... F04B 53/164; F04B 53/16
See application file for complete search history.

(56) References Cited

U.S. PATENT DOCUMENTS

| | | | | |
|---|---|---|---|---|
| 558,236 | A | 4/1896 | Thomas et al. | |
| 2,217,085 | A | 10/1940 | Wheeler | |
| 3,554,563 | A * | 1/1971 | Schumacher | F16J 15/20 277/540 |
| 4,878,815 | A | 11/1989 | Stachowiak | |
| 4,916,938 | A | 4/1990 | Aikin et al. | |
| 6,305,265 | B1 | 10/2001 | Bingham et al. | |
| 9,845,801 | B1 * | 12/2017 | Shek | F04B 53/02 |
| 11,692,544 | B2 | 7/2023 | Chase | |
| 11,754,068 | B1 | 9/2023 | Brunet et al. | |
| 12,038,086 | B2 * | 7/2024 | Shuck | F16J 15/183 |
| 2003/0227139 | A1 | 12/2003 | Antoun | |
| 2019/0085978 | A1 * | 3/2019 | Chase | F04B 53/02 |
| 2019/0170137 | A1 * | 6/2019 | Chase | F04B 53/164 |
| 2022/0034402 | A1 | 2/2022 | Kiani et al. | |
| 2022/0163031 | A1 * | 5/2022 | Chase | F16J 9/20 |
| 2022/0163032 | A1 * | 5/2022 | Chase | F16J 15/20 |

FOREIGN PATENT DOCUMENTS

| | | | |
|---|---|---|---|
| AR | 127570 | A1 | 2/2024 |
| CN | 106369165 | A | 2/2017 |
| WO | 2021195572 | A1 | 9/2021 |

OTHER PUBLICATIONS

International Search Report and Written Opinion in counterpart International Application No. PCT/US2025/021723, mailed Jun. 2, 2025, 15 pages.

* cited by examiner

*Primary Examiner* — Eugene G Byrd
(74) *Attorney, Agent, or Firm* — Edell, Shapiro & Finnan, LLC

(57) ABSTRACT

A junk ring includes an upstream end, a downstream end, and a tapered outer surface between its upstream end and downstream end. The tapered outer surface extends at an angle relative to the upstream end and relative to the downstream end to allow the junk ring to tilt or tip during installation or removal without getting stuck in a fluid end bore segment.

20 Claims, 7 Drawing Sheets

JUNK RING FOR RECIPROCATING PUMP

CROSS-REFERENCE TO RELATED APPLICATION

This application claims priority to and the benefit of U.S. Provisional Patent Application No. 63/637,114, filed Apr. 22, 2024, entitled "JUNK RING FOR RECIPROCATING PUMP," and hereby incorporated by reference in its entirety for all purposes.

TECHNICAL FIELD

The present disclosure relates to the field of high pressure reciprocating pumps and, in particular, to a junk ring for packing of a high pressure reciprocating pump.

BACKGROUND

High pressure reciprocating pumps are often used to deliver high pressure fluids during earth drilling operations. A packing arrangement is provided to seal against a reciprocating element to reduce the likelihood of leakage of fluid between a fluid end casing and the reciprocating element. The packing arrangement may also protect the reciprocating element from grinding against potentially abrasive components contained in the fluid. However, the packing has a lifetime and, thus, packing arrangements must be continually installed into and removed from the fluid end casing.

SUMMARY

The present application relates to a junk ring for a packing arrangement of a high pressure reciprocating pump. The junk ring may be provided independent of any other elements incorporated in a packing arrangement, and/or the junk ring may be incorporated in a reciprocating pump.

In accordance with at least one embodiment, the present application is directed to a junk ring for a packing arrangement of a reciprocating pump. The junk ring includes an upstream end, a downstream end disposed opposite of the upstream end, and a tapered outer surface extending between the upstream end and the downstream end. The tapered outer surface is configured to ease installation and removal of the junk ring from a fluid end casing of the reciprocating pump.

In accordance with at least another embodiment, the present application is directed to a packing arrangement of a reciprocating pump. The packing arrangement includes a header ring with an upstream surface and a junk ring disposed upstream of the header ring. The junk ring includes a downstream end configured to engage the upstream surface of the header ring, an upstream end disposed opposite of the downstream end, and a tapered outer surface extending between the downstream end and the upstream end.

In accordance with at least one other embodiment, the present application is directed to a reciprocating pump. The reciprocating pump includes a reciprocating element configured to reciprocate during operation of the reciprocating pump to pressurize a fluid and a junk ring. The junk ring includes an upstream end, a downstream end disposed opposite of the upstream end, and a tapered outer surface facing away from the reciprocating element and extending between the upstream end and the downstream end.

BRIEF DESCRIPTION OF THE DRAWINGS

To complete the description and in order to provide for a better understanding of the present disclosure, a set of drawings is provided. The drawings form an integral part of the description and illustrate an embodiment of the present disclosure, which should not be interpreted as restricting the scope of the disclosure, but just as an example of how the disclosure can be carried out. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the disclosure. Embodiments of the disclosure will be described by way of example, with reference to the above-mentioned drawings showing elements and results according to the present disclosure.

Generally, the junk ring presented herein is an upstream ring of a packing set and has a tapered outer surface extending between its upstream end and its downstream end. For example, the junk ring may include a tapered outer surface that extends from the upstream end of the junk ring to a cylindrical outer surface that, in turn, extends to the downstream end of the junk ring. The tapered outer surface allows the junk ring to tilt or tip during installation or removal without getting stuck in a fluid end bore segment. As is detailed below, the junk ring may be formed from steel, bronze, alloy-metal, plastic, or other hard materials and may be included in a packing set or arrangement configured to block fluid flow between a reciprocating element (e.g., a plunger) and a casing of a fluid end a reciprocating pump.

By comparison, many prior art junk rings have an outer surface that is cylindrical proximate its upstream end (e.g., a corner that is a portion of a rectangular cross-section). If these prior art junk rings tip or tilt, the junk ring can get stuck against the bore segment of the fluid end. Indeed, it is relatively common for prior art junk rings to get stuck in a bore segment because junk rings need to fit very tightly in a bore segment to provide a desired performance, but junk rings are also often relatively long (e.g., as compared to other rings in the packing). Also, junk rings are often installed and removed by hand, which leads to constant tipping or tilting during installation or removal. Moreover, during removal, sand or other particulates may be disposed on and/or around the junk ring, further reducing the relatively small clearance for installation and removal. Since junk rings are often made of hard metals and/or plastics, junk rings often do not have flexibility that allows them to be pried loose after getting stuck. Instead, an operator often needs to hammer the junk ring out of the bore segment, which is time consuming, tiring, and potentially dangerous, both to the operator and the fluid end and/or components installed in the fluid end.

Figure 1:
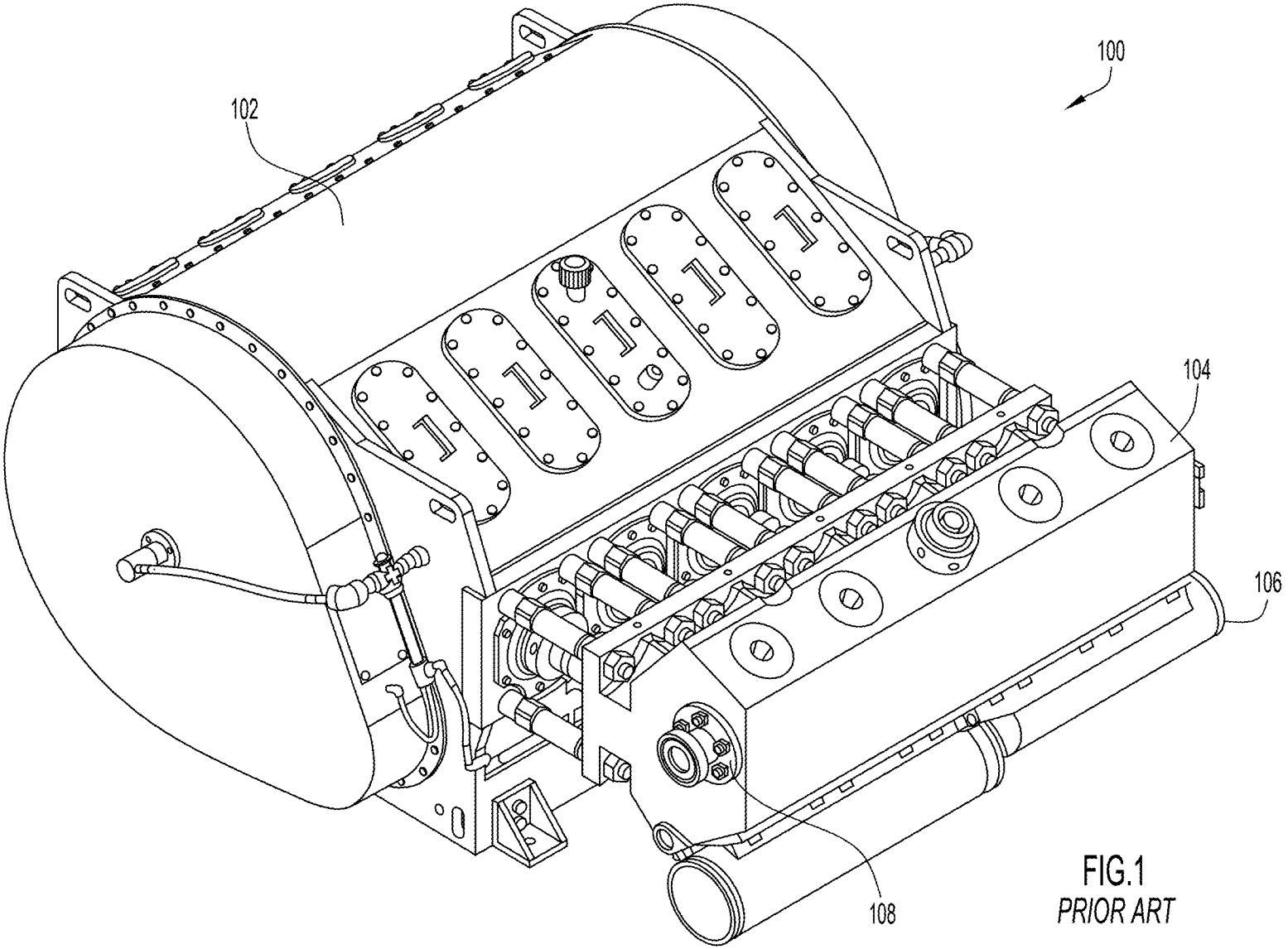
FIG.1 PRIOR ART
FIG. 1 is a perspective view of a prior art reciprocating pump including a fluid end, in which aspects of the present disclosure may be incorporated.

FIG. 1 is an exemplary embodiment of a reciprocating pump 100 in which a scraper or header ring assembly (e.g., an annular scraper or header ring assembly) presented herein may be included. The reciprocating pump 100 includes a power end 102 and a fluid end 104. The power end 102 includes a crankshaft that drives a plurality of reciprocating elements within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations.

Often, the reciprocating pump 100 may be quite large and may, for example, be supported by a semi-tractor truck ("semi") that can move the reciprocating pump 100 to and from a well. For example, in some instances, a semi may move the reciprocating pump 100 off a well to perform maintenance on the reciprocating pump 100. However, a reciprocating pump 100 is typically moved off a well only when a replacement pump (and an associated semi) is available to move into place at the well, which may be rare. Thus, often, the reciprocating pump 100 is taken offline at a well and maintenance is performed while the reciprocating pump 100 remains on the well. If not for this maintenance, the reciprocating pump 100 could operate continuously to extract natural oil and gas. Consequently, any improvements that extend the lifespan of components of the reciprocating pump 100, especially typical "wear" components, and extend the time between maintenance operations (i.e., between downtime) are highly desirable.

Figure 2:
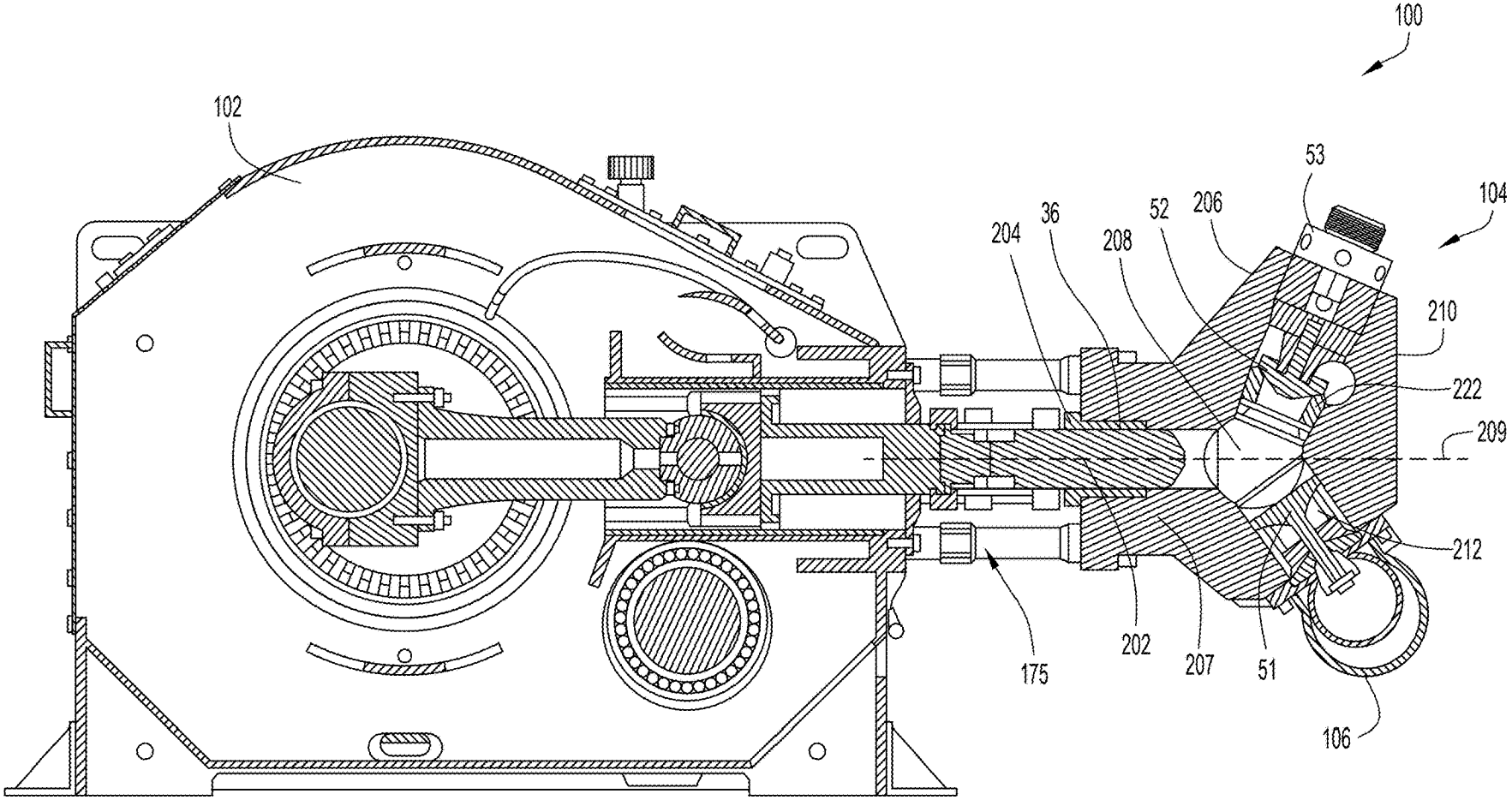
FIG. 2 is a cross-sectional view of the prior art reciprocating pump of FIG. 1, taken along a plane that is parallel to a central axis.

FIG. 2 shows a side, cross-sectional view of the reciprocating pump 100 taken along a central axis 209 of a reciprocating element 202 included in the reciprocating pump 100. Thus, FIG. 2 depicts a single pumping chamber 208. However, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208, and each pumping chamber 208 includes a reciprocating element 202 that reciprocates within the casing 206. However, side-by-side pumping chambers 208 need not be defined by a single casing 206. For example, in some embodiments, the fluid end 104 may be modular, and different casing segments may house one or more pumping chambers 208. In any case, the one or more pumping chambers 208 are arranged side-by-side so that corresponding conduits are positioned adjacent to each other and generate substantially parallel pumping action. Specifically, with each stroke of the reciprocating element 202, low pressure fluid is drawn into the pumping chamber 208 and high pressure fluid is discharged from the pumping chamber 208.

In the depicted embodiment, the fluid end 104 includes a first bore 204 that intersects an inlet bore 212 and an outlet bore 222. The inlet bore 212 defines a fluid path through the fluid end 104 that connects the pumping chamber 208 to a piping system 106 delivering fluid to the fluid end 104. Meanwhile, the outlet bore 222 allows compressed fluid to exit the fluid end 104. The bores 212, 222 may include valve components 51, 52, respectively, (e.g., one-way valves) that allow the bores 212 and 222 to selectively open and deliver a fluid through the fluid end 104 during operation. Typically, the valve components 51 in the inlet bore 212 may be secured therein by the piping system 106. Meanwhile, the valve components 52 in the outlet bore 222 may be secured therein by a closure assembly 53 that, in the example illustrated in FIG. 2, is removably coupled to the fluid end 104 via threads.

In operation, fluid may enter fluid end 104 via outer openings of the inlet bores 212 and exit the fluid end 104 via outer openings of the outlet bores 222. More specifically, fluid may enter the inlet bores 212 via pipes of the piping system 106, flow through the pumping chamber 208 (e.g., due to reciprocation of the reciprocating element 202), and then through the outlet bores 222 into a channel 108 (see FIG. 1). However, the piping system 106 and the channel 108 are merely example conduits and, in various embodiments, the fluid end 104 may receive and discharge fluid via any number of pipes and/or conduits, along pathways of any desirable size or shape.

Meanwhile, each of the first bores 204 defines, at least in part, a cylinder for a reciprocating element 202 and/or connects the casing 206 to a cylinder for a reciprocating element 202. Reciprocation of the reciprocating element 202 in or adjacent to the first bore 204, which may be referred to as a reciprocation bore (or, for fracking applications, a plunger bore), draws fluid into the pumping chamber 208 via the inlet bore 212 and pumps the fluid out of the pumping chamber 208 via the outlet bore 222.

Additionally, a casing segment 207 houses a packing assembly or packing arrangement 36 configured to seal against the reciprocating element 202 disposed interiorly of the packing arrangement 36. The packing arrangement 36 therefore blocks fluid flow between the casing 206 and the reciprocating element 202 (e.g., to force fluid flow to the outlet bore 222). Moreover, the packing arrangement 36 can block abrasive material (e.g., debris) within the fluid from imparting an excessive amount of force against the casing 206 and/or against the reciprocating element 202 that could otherwise change a geometry of the casing 206 and/or of the reciprocating element 202. Thus, the packing arrangement 36 may help maintain a desirable structural integrity of the casing 206 and/or of the reciprocating element 202 to improve a useful lifespan of the reciprocating pump 100.

To help provide access to the pumping chamber 208 and/or components positioned therein, such as for performing maintenance operations, some fluid ends have access bores that are often aligned with (and sometimes coaxial with) the first bore 204. Other fluid ends need not include an access bore and, thus, such an access bore is not illustrated in FIGS. 1 and 2. Regardless of whether the fluid end 104 includes an access bore, the packing arrangement 36 typically is to be replaced from an outer opening of the first bore 204 (i.e., a side of the first bore 204 aligned with the external surface 210 of the casing 206). At the same time, to operate properly, the fluid end 104 is to be securely and stably coupled to the power end 102. Thus, the fluid end 104 is directly coupled to the power end 102 with relatively short couplers 175, and at least a portion of the reciprocating pump 100 is to be disassembled to access the first bore 204, e.g., to replace packing arrangement 36.

In various embodiments, the fluid end 104 may be shaped differently and/or have different features but may still generally perform the same functions, define similar structures, and house similar components. For example, while the fluid end 104 includes a first bore 204 that intersects an inlet bore 212 and an outlet bore 222 at skewed angles, other fluid ends may include any number of bores arranged along any desired angle or angles, for example, to intersect the first bore 204 (and/or an access bore) substantially orthogonally and/or so that two or more bores are substantially coaxial. Generally, the bores 212, 222, as well as any other bores (i.e., segments, conduits, etc.), may intersect to form the pumping chamber 208, may be cylindrical or non-cylindrical, and may define openings at an external surface 210 of the casing 206. Additionally, the bores 212, 222, as well as any other bores (i.e., segments, conduits, etc.), may receive various components or structures, such as sealing assemblies or components thereof.

Figure 3:
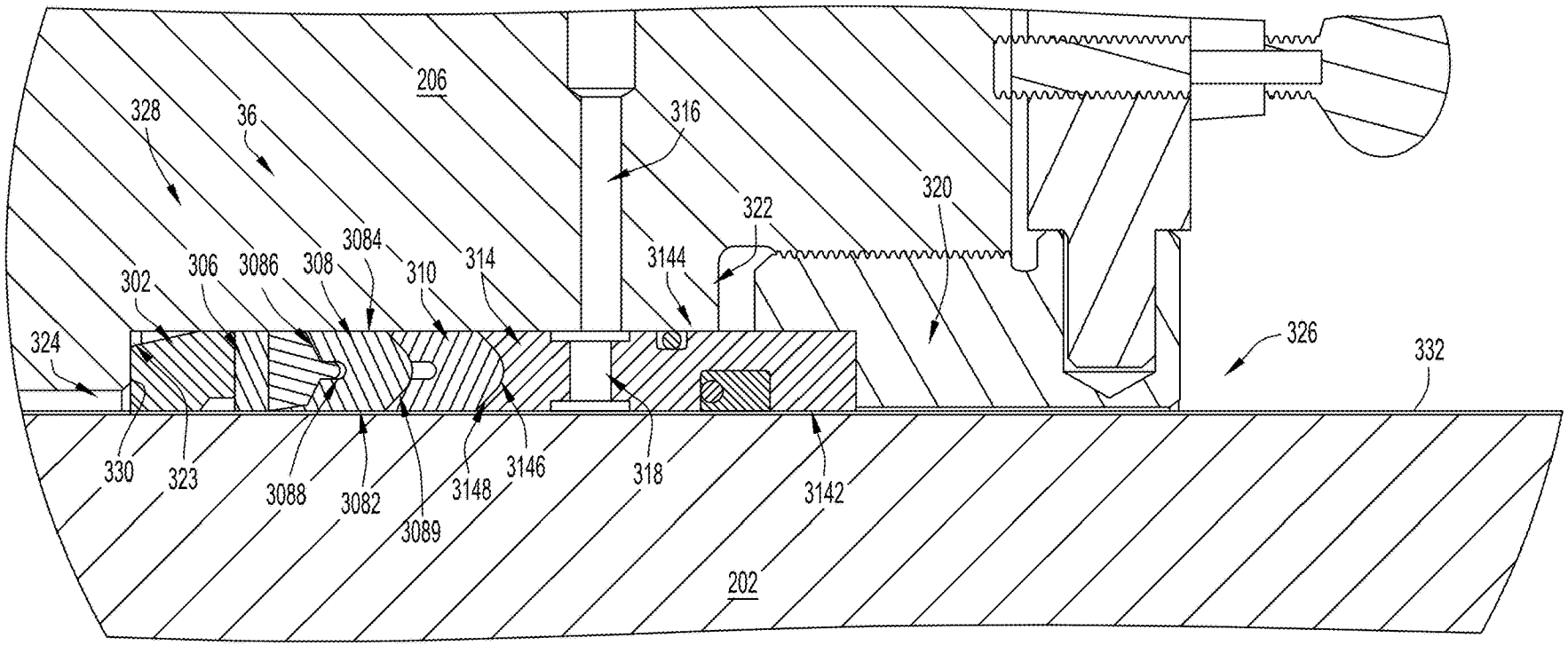
FIG. 3 is a cross-sectional view of a packing arrangement for the reciprocating pump of FIG. 1 including the junk ring presented herein.

FIG. 3 shows a packing arrangement 36 within a packing box 322 that is formed as part of the casing 206 of the fluid end 104 of reciprocating pump 100. The packing box 322 may be defined by the casing 206, a stuffing box of the fluid end 104, a sleeve disposed in the casing 206, and the like. The packing arrangement 36 includes a junk ring 302 of the present application, and positioning the junk ring 302 in the packing box 322 forms a gap 323 between the packing box 322 and the junk ring 302, and the gap 323 facilitates installation of the junk ring 302, as discussed herein. As is discussed in detail below, when the packing arrangement 36 is disposed in the casing 206, compression of the packing arrangement 36 causes the packing arrangement 36 to seal against the casing 206 and the reciprocating element 202.

Overall, the packing arrangement 36 includes the junk ring 302, a scraper or header ring 306, a first pressure ring 308, a second pressure ring 310, a lantern ring 314, and a packing nut 320. However, in other embodiments, the packing arrangement 36 might include any combination of components arranged in any order with the junk ring 302 of the present application. For example, an alternative embodiment might include only one pressure ring, three or more pressure rings, any number of support rings, or any other such rings, and each of these components may have suitable axial dimensions to collectively span the axial distance between the junk ring 302 and the packing nut 320 (each of which might also have varied dimensions across different embodiments).

Also, before discussing the packing arrangement 36 in detail it is important to understand the terms "upstream" and "downstream." Any flow through the packing arrangement 36 or between the packing arrangement 36 and the reciprocating element 202 flows from a high pressure side 324 of the packing box 322 to a low pressure side 326. Thus, if a first component is described as being "upstream" of a second component, the first component will be closer to the high pressure side 324 than the second component is to the high pressure side 324. Likewise, if a first component is described as being "downstream" of a second component, the first component will be closer to the low pressure side 326 than the second component is to the low pressure side 326.

Thus, starting at the downstream end of FIG. 3, the first component is a packing nut 320. In the embodiment of FIG. 3, the packing nut 320 threadably engages the casing 206. The threaded engagement allows the packing nut 320 to compress the lantern ring 314 against the second pressure ring 310, the first pressure ring 308, and the scraper or header ring 306. The second pressure ring 310, the first pressure ring 308, and the scraper or header ring 306 may be referred to collectively as a stack 328. This compression causes the stack 328 to expand radially, towards both a surface or bore 330 of the packing box 322 and an outer surface 332 of the reciprocating element 202. This radial expansion creates seals between: (1) the stack 328 and the surface 330 of the packing box 322; and (2) the stack and the outer surface 332 of the reciprocating element 202. However, in other embodiments, similar compression can be created without a threaded connection and/or with a component that is different from the depicted packing nut 320 in any manner now known or developed hereafter.

Moving upstream, the next component is the lantern ring 314. The lantern ring 314 is an elongated annular ring that includes an inner surface 3142 that faces the reciprocating element 202 and an outer surface 3144 that faces the surface 330 of the packing box 322. In the depicted embodiment, the upstream (high pressure) side 3146 of lantern ring 314 includes a female chevron portion that is arranged to receive a male chevron portion of a downstream (low pressure) side 3148 of the second pressure ring 310, but other embodiments need not include such shaping. In any case, the lantern ring 314 may be formed from a metal such as aluminum, bronze, aluminum-bronze alloy, or a nickel or ferrous alloy. Thus, the lantern ring 314 may, in at least some embodiments, include sealing elements (e.g., O-rings or annular seals) embedded therein (not labeled). The lantern ring 314 may also include one or more lube oil bores 318 that extend between its inner surface 3142 and its outer surface 3144 to provide a flow path for lube oil that is delivered to the packing arrangement 36 via an oil passage 316 formed in casing 206. The lube oil creates a pressure seal that enhances the function of the packing arrangement 36 while also providing lubrication between the reciprocating element 202 and the packing arrangement 36.

Again moving upstream, the next components are pressure rings 310 and 308. In the depicted embodiment, the second pressure ring 310 is identical to the first pressure ring 308. However, in other embodiments, the second pressure ring 310 could be made from a different material and/or have different dimensions as compared to the first pressure ring 308. For example, the second pressure ring 310 could have a different height (insofar as "height" refers to a dimension spanning the flow or axial direction), different upstream chevron shape, different aperture shape, different aperture size, and/or different downstream chevron shape as compared to the first pressure ring 308.

Thus, for brevity, first pressure ring 308 is now described and such description may be applicable to both first pressure ring 308 and second pressure ring 310 of the depicted embodiment. Generally, the first pressure ring 308 is an annular ring that includes a tapered cylindrical inner surface 3082 and a tapered cylindrical outer surface 3084. The tapered cylindrical inner surface 3082 abuts the outer surface 332 of the reciprocating element 202 while the tapered cylindrical outer surface 3084 abuts the surface 330 of the packing box 322. An upstream side 3086 (high pressure side) of the first pressure ring 308 includes a female chevron portion arranged to receive a male chevron portion of the scraper or header ring 306. An aperture 3088 is formed in the female chevron portion and provides a relief space that allows the legs of the female chevron portion to flex inwards in response to compression (e.g., generated by the rigid sides of the packing box 322 and reciprocating element 202).

The downstream side 3089 (low pressure side) of the first pressure ring 308 includes a male chevron portion with an apex that extends toward the low pressure side 326 of the packing box 322. In at least some embodiments, the male chevron portion and the female chevron portion have like dimensions so that the downstream side 3089 of first pressure ring 308 matches or mirrors the upstream side 3086 of the first pressure ring 308. However, the downstream side 3089 need not necessarily match or mirror the upstream side 3086.

Regardless of the dimensions, features, and/or characteristics of pressure rings 308 and 310, pressure rings 308 and 310 may be the primary sealing components of the packing arrangement 36, bearing the brunt of the pressure applied by the high pressure fluid within the pumping chamber 208. Therefore, the pressure rings 308, 310 may be stiff or inflexible and lack springiness, at least as compared to scraper or header ring 306. For example, in at least some embodiments, the first pressure ring 308 and the second pressure ring 310 are formed from an elastomer impregnated aramid fabric, but in other embodiments, one or both of pressure ring 308 and pressure ring 310 may be formed from other suitable materials.

Still referring to FIG. 3 and continuing to move upstream along the packing arrangement 36, in the depicted embodiment, the scraper or header ring 306 is immediately upstream of the first pressure ring 308 and the junk ring 302 is immediately upstream of the scraper or header ring 306. Thus, in packing arrangement 36, the junk ring 302 is positioned within the packing box 322 adjacent the high pressure side 324 and the scraper or header ring 306 is positioned immediately downstream of the junk ring 302. The remainder of the packing arrangement 36 is disposed downstream of the scraper or header ring 306. That is, the first pressure ring 308 is downstream of the scraper or header ring 306, the second pressure ring 310 is downstream of the first pressure ring 308, the lantern ring 314 is downstream of the second pressure ring 310, and the packing nut 320 is downstream of the lantern ring 314.

The scraper or header ring 306, or portions thereof may be fabricated from any commonly used resilient materials, such as homogeneous elastomers, filled elastomers, partially fabric reinforced elastomers, and full fabric reinforced elastomers. Suitable resilient elastomeric materials include, but are not limited to, thermoplastic polyurethane (TPU), thermoplastic copolyester (COPE), ethylene propylene diene monomer (EPDM), highly saturated nitrile rubber (HNBR), reinforced versions of the foregoing materials, such as versions reinforced with fibers or laminations of woven material, as well as combinations of any of the foregoing materials. Forming the scraper or header ring 306 from a resilient material allows the scraper or header ring 306 to expand radially in response to axial compression and form a seal against the reciprocating element 202 (e.g., a plunger) and/or the casing 206.

By comparison, the junk ring 302, or portions thereof, may be fabricated from any of the foregoing materials and/or from metals, metal alloys, and/or plastics. Thus, in at least some embodiments, the junk ring 302 may have a resiliency that is less than the resiliency of the scraper or header ring 306. Put another way, the scraper or header ring 306 may have a first resiliency and the junk ring 302 may have a second resiliency that is less than the first resiliency, insofar as "resiliency" is used herein to describe stiffness, pliability, and other such characteristics and may be represented by, for example, a durometer measurement. In these embodiments, the junk ring 302 may resist axial forces generated by compression of the scraper or header ring 306 against the junk ring 302 (e.g., when the packing arrangement 36 is compressed in the upstream direction) so that the axial compression causes the scraper or header ring 306 to expand radially.

As a specific example, the scraper or header ring 306 may be manufactured from a resilient elastomer and the junk ring 302 may be fabricated from steel, aluminum, bronze, brass, plastic(s) and/or composite plastic(s). Such compositions may be particularly useful when the scraper or header ring 306 is immediately adjacent the high pressure side 324 of a packing box 322 (e.g., abutting a metal casing 206), as is depicted in FIG. 3. In these instances, the junk ring 302 may act similar to a conventional metal junk ring that shrinks the gap between the casing 206 and the reciprocating element 202 (e.g., a plunger) upstream of resilient sealing rings (e.g., rings 306, 308, and/or 310).

However, to be clear, for the purposes of this application, the term "junk ring" does not signify that a ring needs to be a metal or metal alloy ring nor does the term "junk ring" require a particular placement in the stack. Instead, "junk ring" is a term used to describe ring 302 and is only used because the ring 302 may, in some embodiments, perform tasks often performed by a conventional junk ring (among other tasks). In fact, in some embodiments, forming the junk ring 302 from a plastic or plastic composite may provide advantages over traditional metal junk rings. First, manufacturing the junk ring 302 from plastic and/or plastic composite(s) may reduce manufacturing costs as compared to manufacturing from metal. For example, plastics and plastic composites can be molded and quickly mass produced while also avoiding the material costs associated with metal. Second, a plastic or plastic composite ring may be lighter than a metal ring and, thus, may be easier to install in a reciprocating pump. Finally, plastics do not typically have recycling value and thus, will discourage theft for recycling value.

Alternatively, the junk ring 302 may be fabricated from at least the same materials, or similar materials, as the scraper or header ring 306 and may have the same resiliency as or a similar resiliency to the scraper or header ring 306. In these embodiments, the scraper or header ring 306 and the junk ring 302 may both expand radially in response to axial compression (e.g., when the packing arrangement 36 is compressed in the upstream direction); however, the amount of axial compression of each of ring 302 and ring 306 may depend on its resiliency (e.g., on the particular materials and construction used to form the ring). Such compositions may be particularly useful when the packing arrangement 36 includes another ring (not depicted) between scraper or header ring 306 and first pressure ring 308, between scraper or header ring 306 and junk ring 302, and/or upstream of junk ring 302 (e.g., so that junk ring 302 is not immediately adjacent the high pressure side 324 of a packing box 322 and abutting a metal casing).

Figure 4:
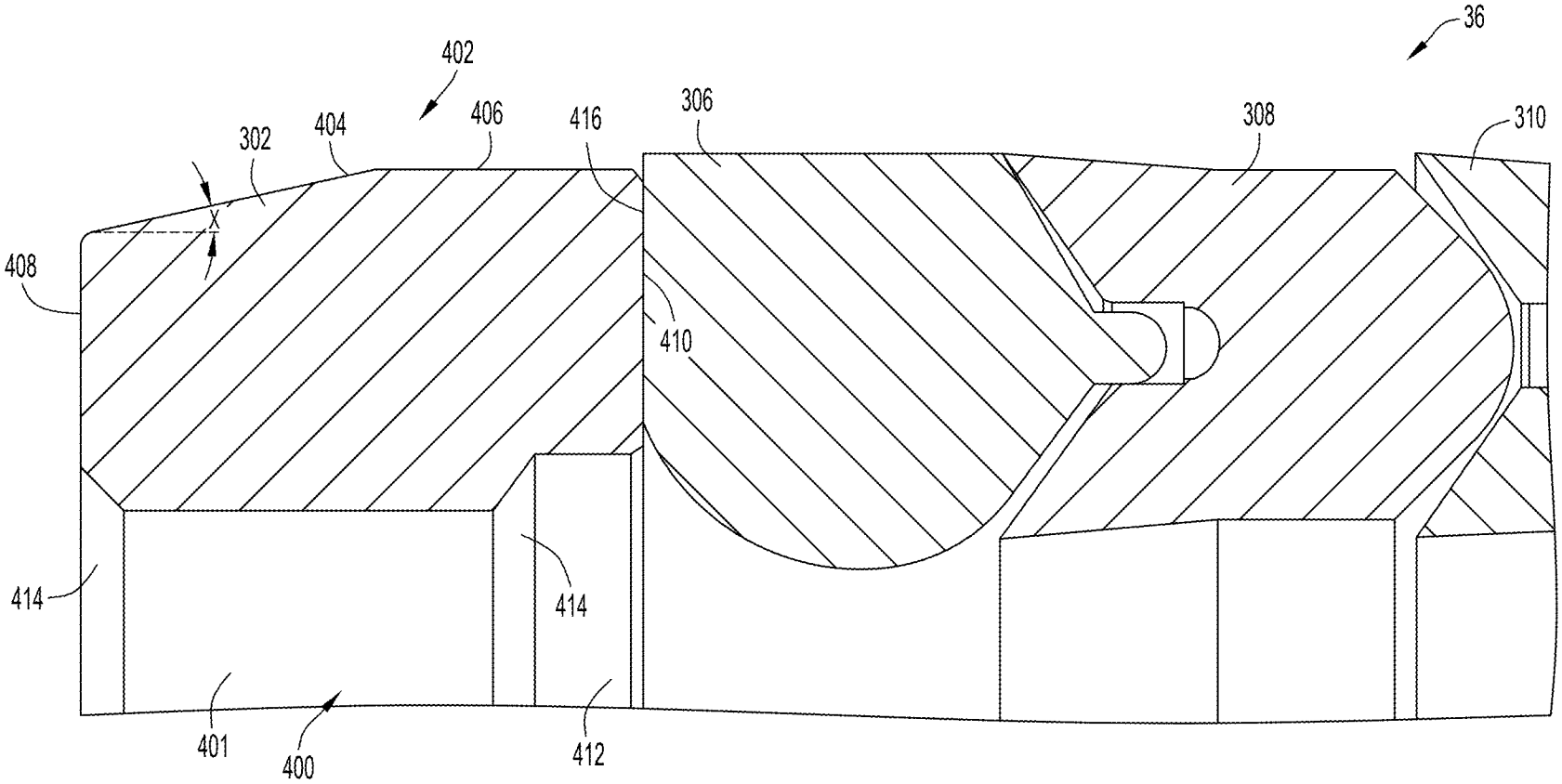
FIG. 4 is a detail view of a portion of the cross-sectional view of FIG. 3.

Still referring to FIG. 3, but now in combination with FIG. 4, in the present application, the geometry of the junk ring 302 is particularly advantageous at least because it eases installation and removal procedures without adversely affecting the functionality of the junk ring 302. To be clear, FIG. 4 illustrates a portion of the packing arrangement 36 in further detail, but now the packing arrangement 36 is shown independent of the casing 206 (i.e., while removed from the casing 206). However, since junk ring 302 is relatively stiff (i.e., less susceptible to deformation than scraper or header ring 306), the junk ring 302 may have the same geometry/appearance when installed in the packing box 322 and when removed therefrom.

As can be seen in FIG. 4, the junk ring 302 includes an inner surface 400 (e.g., a cylindrical inner surface) configured to face and abut the reciprocating element 202, as well as an outer surface 402 configured to face away from the reciprocating element 202. The outer surface 402 of the junk ring 302 in the illustrated embodiment includes a tapered portion 404 and a cylindrical portion 406. Critically, the tapered portion 404 creates the gap 323 (see FIG. 3) between the outer surface 402 of the junk ring 302 and the packing box 322 when the junk ring 302 is installed in the packing box 322 and/or during installation or removal of the junk ring 302 into/from the packing box 322. To this end, as an example, the packing box 322 may have a rectangular shape (e.g., the surface 330 of the packing box 322 is planar) such that, in an uncompressed configuration of the junk ring 302, the cylindrical portion 406 extends along (e.g., is flush with) the surface 330 of the packing box 322, whereas the tapered portion 404 extends away from the surface 330 to provide the gap 323 between the surface 330 and the tapered portion 404. However, in additional or alternative embodiments, the packing box 322 has any suitable shape in which engagement between the junk ring 302 and the packing box 322 causes the junk ring 302 to create the gap 323 between the surface 330 of the packing box 322 and the tapered portion 404 in the uncompressed configuration.

Thus, during installation or removal, the junk ring 302 can tilt with respect to the packing box 322 without immediately getting stuck. This creates a margin of error for tilting or tipping during installation or removal, which is most often a manual operation (e.g., completed by hand). Specifically, the junk ring 302 can tilt off-center to an angle X (e.g., an acute angle, an oblique angle) of the taper defined by tapered portion 404 with respect to the cylindrical portion 406, which may, for example, be more than 0 degrees and less than 90 degrees, more than 0 degrees and less than approximately 60 degrees, more than 0 degrees and less than approximately 45 degrees, more than 0 degrees and less than approximately 30 degrees, more than approximately 5 degrees and less than approximately 30 degrees, or any other desired range that allows installation with tipping or tiling. As a specific example, the taper of tapered portion 404 might have an angle X of approximately 12.5 degrees.

However, at the same time, it is also important that the tapered portion 404 extends to the cylindrical portion 406 because the cylindrical portion 406 allows the junk ring 302 to sit in the packing box 322 in proper alignment with the packing box 322 (e.g., properly centered and concentric with the reciprocating element 202). When the tapered portion 404 is upstream of the cylindrical portion 406, the tapered portion 404 allows tilting during installation or removal, thereby easing these operations and discouraging sticking, but the junk ring 302 can still properly align with the packing box 322. In some embodiments, the cylindrical portion 406 may also help create seals for the packing arrangement 36. For example, the cylindrical portion 406 of the junk ring 302 may directly engage the packing box 322. Additionally or alternatively, the cylindrical portion 406 of the junk ring 302 may shrink a gap between the junk ring 302 and the packing box 322 and/or the reciprocating element 202, which may improve performance of rings disposed downstream of the junk ring 302.

In the depicted embodiment, the junk ring 302 also includes a planar upstream surface 408 and a planar downstream surface 410. In fact, in the depicted embodiment, the planar upstream surface 408 and the planar downstream surface 410 extend approximately parallel to one another (e.g., an perpendicular to the cylindrical portion 406). The planar upstream surface 408 and the planar downstream surface 410 may allow the junk ring 302 to securely engage (e.g., via flush engagement) a planar high pressure side 324 of the packing box 322 and a planar upstream surface 416 of the scraper or header ring 306, respectively. However, in other embodiments, the upstream surface 408 and downstream surface 410 need not be planar and can have any desired shape, size, geometry, etc., e.g., to engage an adjacent component of a different shape, size, geometry, etc. In any case, the outer surface 402 generally extends between the upstream surface 408 and the downstream surface 410 while an opposing inner surface 400 also generally extends between the upstream surface 408 and the downstream surface 410.

More specifically, in the depicted embodiment, the tapered portion 404 extends directly from the upstream surface 408, farther away from the reciprocating element 202 toward the downstream surface 410, and to the cylindrical portion 406 which, in turn, extends directly from the downstream surface 410. However, in other embodiments, the outer surface 402 might include additional portions or sections between the upstream surface 408 and the tapered portion 404, between the tapered portion 404 and the cylindrical portion 406, and/or between the cylindrical portion 406 and the downstream surface 410. For example, a cylindrical portion (not shown) may be disposed between the upstream surface 408 and the tapered portion 404 while still realizing the advantages of the tapered portion 404. Indeed, the outer surface 402 may include any suitable quantity of cylindrical portions, including more than one cylindrical portion or no cylindrical portions.

It should be noted that junk rings can include any specific geometries in addition to having the tapered portion 404 extending farther away from the reciprocating element 202 toward a downstream surface. Thus, FIG. 4 depicts a junk ring 302 with one example inner surface 400 while FIGS. 5A, 5B, 6A, and 6B depict further examples (described further below) of inner surfaces of junk rings. More specifically, in FIG. 4, the inner surface 400 includes a first cylindrical section 401 that is bounded by chamfered sections 414 and a second cylindrical surface 412 that extends from the downstream surface 410 and is offset from the first cylindrical section 401. In this embodiment, the first cylindrical section 401 extends inwardly (towards reciprocating element 202) further than an amount that the second cylindrical surface 412 extends. Meanwhile, chamfered sections 414 connect the first cylindrical section 401 to the upstream surface 408 and the second cylindrical surface 412.

FIGS. 5A-5B, FIGS. 6A-6B, and FIG. 7 depict alternate embodiment of the junk ring presented herein. Like numerals from FIG. 4 are used across FIGS. 5A-5B, FIGS. 6A-6B, and FIG. 7 to denote like elements of these embodiments. Thus, most notably, all of the embodiments of FIGS. 5A-5B and FIGS. 6A-6B include the same outer surface 402 with tapered portion 404 and cylindrical portion 406 (despite variations being understood to be possible) but have an inner surface 501 and an inner surface 601, respectively, with different features. Additionally, the embodiment of FIG. 7 includes the same inner surface 400 with the same first cylindrical section 401, second cylindrical surface 412, and chamfered sections 414 (despite variations being understood to be possible) but have an outer surface 701 with different features.

Figure 5A:
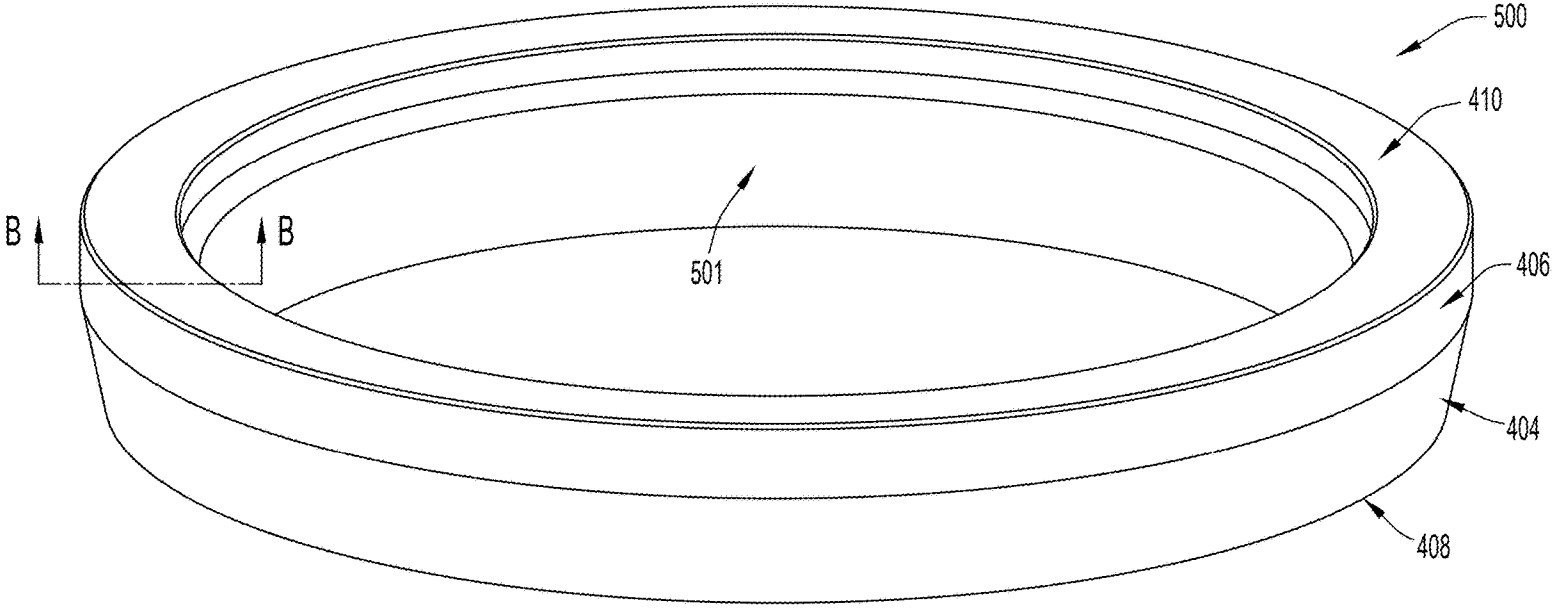
FIG. 5A is a top perspective view of another embodiment of a junk ring formed in accordance with the present disclosure.
Figure 5B:
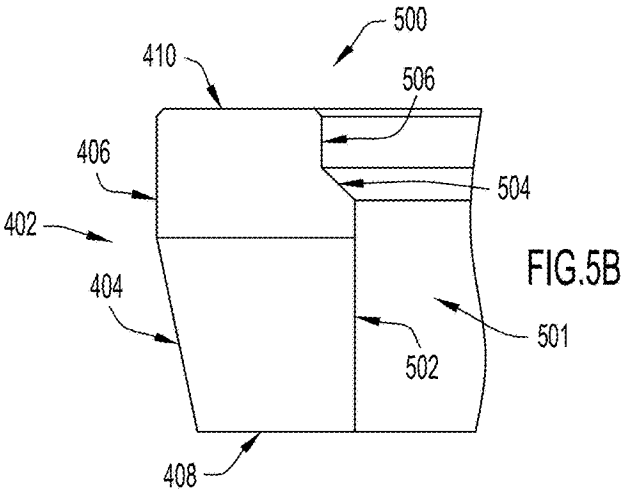
FIG. 5B is a sectional view taken along line B-B of FIG. 5A.

First, as can be seen in the cross-sectional view of FIG. 5B, inner surface 501 includes a first cylindrical section 502 that extends directly from the upstream surface 408 of junk ring 500 to a chamfered section 504. The chamfered section 504 connects the first cylindrical section 502 to a second cylindrical section 506 that, in turn, extends directly to the downstream surface 410 of the junk ring 500. Thus, the inner surface 501 of junk ring 500 is similar to the first cylindrical section 401 of junk ring 302, except that the inner surface 501 has one fewer chamfered section.

Figure 6A:
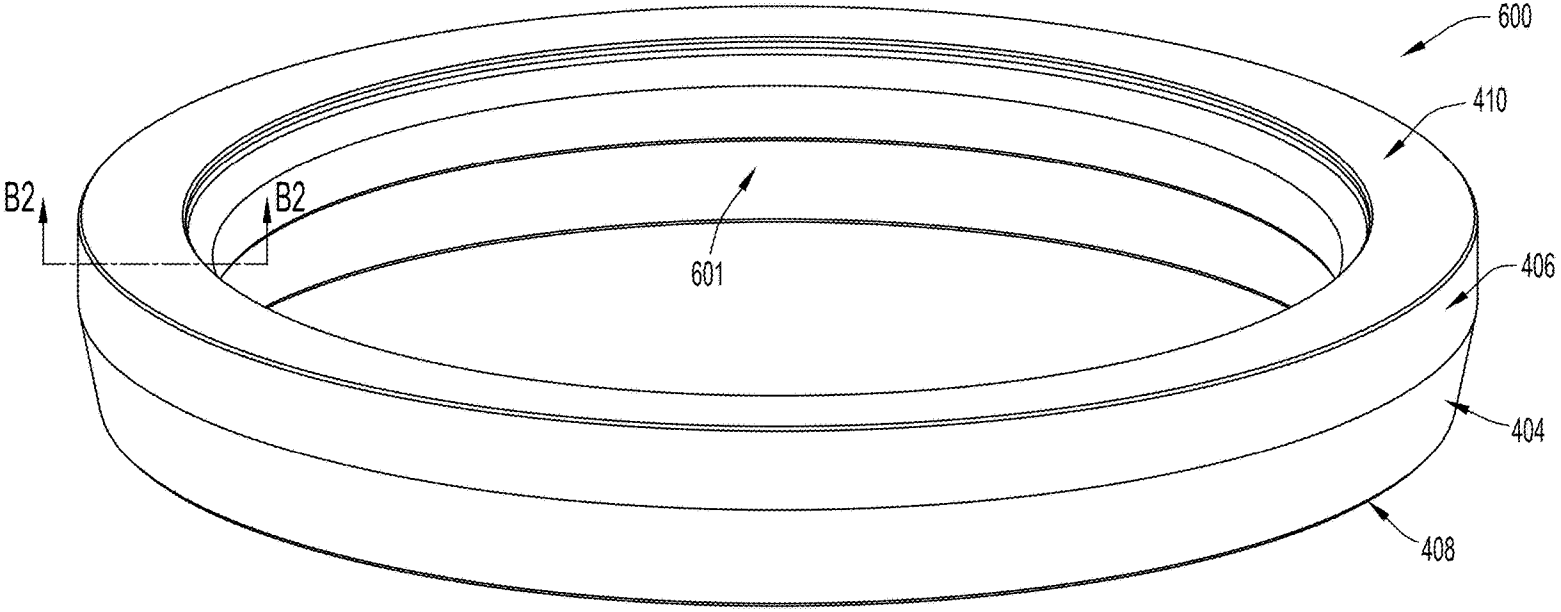
FIG. 6A is a top perspective view of yet another embodiment of a junk ring formed in accordance with the present disclosure.
Figure 6B:
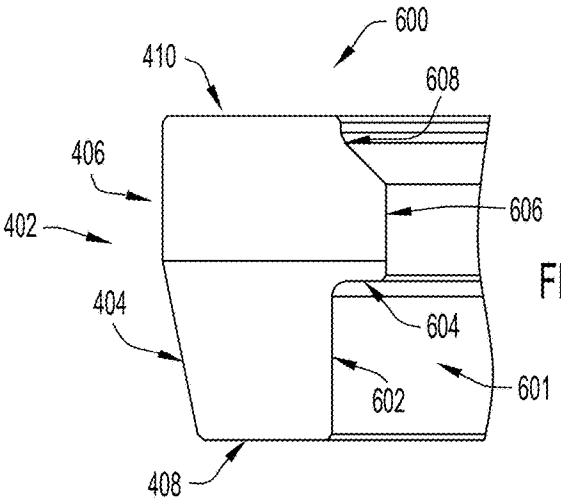
FIG. 6B is a sectional view taken along line B2-B2 of FIG. 6A.

Second, as can be seen in the cross-sectional view of FIG. 6B, inner surface 601 includes a first cylindrical section 602 that extends directly from the upstream surface 408 of junk ring 600 to a rounded section 604. The rounded section 604 connects the first cylindrical section 602 to a second cylindrical section 606 that, in turn, extends to a chamfered section 608. The chamfered section 608 extends directly to the downstream surface 410 of the junk ring 600.

Figure 7:
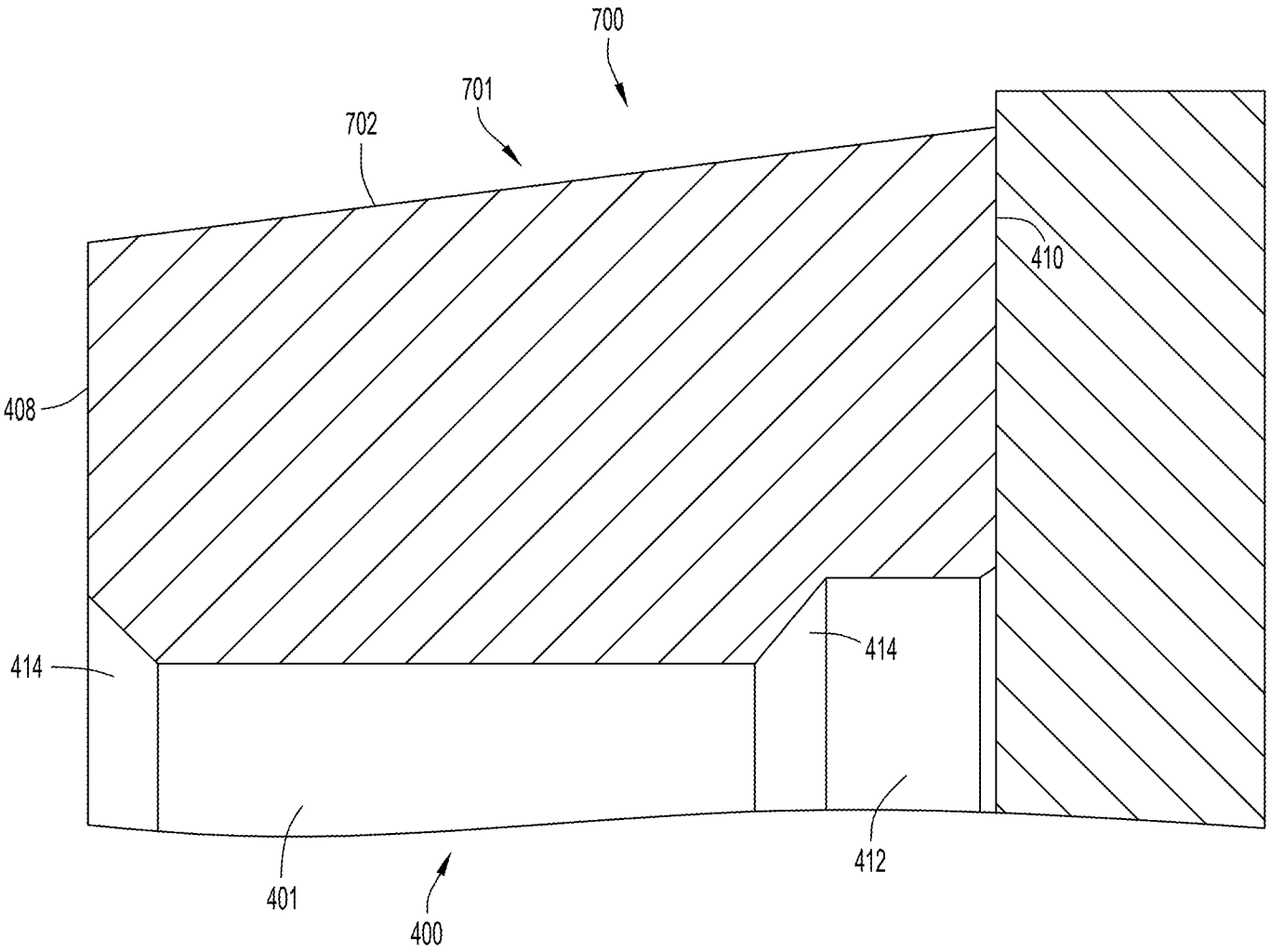
FIG. 7 is a sectional view of still another embodiment of a junk ring formed in accordance with the present disclosure.

Third, as can be seen in the cross-sectional view of FIG. 7, outer surface 701 includes a tapered portion 702 that extends directly from the upstream surface 408 of the junk ring 700 to the downstream surface 410 of the junk ring 700. In other words, the outer surface 701 of the junk ring 700 does not include a cylindrical portion or any other portion between the upstream surface 408 and the tapered portion 702 or between the downstream surface 410 and the tapered portion 702.

Overall, variations in the inner surface of the junk ring presented herein may make the junk ring compatible with different packing rings and/or different packing boxes (whether formed by a casing or by another component). However, as long as these inner surface variations are utilized with the outer surface geometry presented herein—or the contemplated variations thereof—the junk rings will realize the advantages discussed in this application. That is, a junk ring with the outer geometry features discussed here can realize the advantages discussed in this application when paired with downstream, upstream, and inner surfaces having any desirable geometries or features.

Moreover, while the disclosure has been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present disclosure cover the modifications and variations of this disclosure that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". Also, any ranges provided herein should be understood to include their bounds, so that, for example, a range of 80-90 includes both 80 and 90.

The invention claimed is:

1. A junk ring for a packing arrangement of a reciprocating pump, comprising:
   - an upstream end;
   - a downstream end disposed opposite of the upstream end; and
   - a tapered outer surface extending between the upstream end and the downstream end, wherein the reciprocating pump defines a packing box, and the junk ring is configured to engage with a surface of the packing box such that the tapered outer surface extends away from the surface of the packing box to form a gap between the tapered outer surface of the junk ring and the surface of the packing box.

2. The junk ring of claim 1, wherein the tapered outer surface extends at an oblique angle relative to the upstream end.

3. The junk ring of claim 1, wherein the tapered outer surface extends at an oblique angle relative to the downstream end.

4. The junk ring of claim 1, wherein the tapered outer surface extends directly from the upstream end.

5. The junk ring of claim 4, comprising a cylindrical portion extending between the tapered outer surface and the downstream end.

6. The junk ring of claim 5, wherein the cylindrical portion extends directly from the downstream end.

7. The junk ring of claim 5, wherein the cylindrical portion is perpendicular to the upstream end and/or to the downstream end.

8. The junk ring of claim 7, wherein the tapered outer surface extends at an oblique angle relative to the cylindrical portion.

9. The junk ring of claim 8, wherein the oblique angle is between 0 degrees and 45 degrees.

10. The junk ring of claim 1, wherein the tapered outer surface extends directly from the downstream end.

11. A packing arrangement of a reciprocating pump, the packing arrangement comprising:
   - a header ring comprising an upstream surface; and
   - a junk ring disposed upstream of the header ring, wherein the junk ring comprises:
     - a downstream end configured to engage the upstream surface of the header ring;
     - an upstream end disposed opposite of the downstream end; and
     - a tapered outer surface extending between the downstream end and the upstream end, wherein the reciprocating pump defines a packing box, and the junk ring is configured to engage with a surface of the packing box such that the tapered outer surface extends away from the surface of the packing box to form a gap between the tapered outer surface of the junk ring and the surface of the packing box.

12. The packing arrangement of claim 11, wherein the upstream surface of the header ring and the downstream end of the junk ring are planar.

13. The packing arrangement of claim 11, wherein the tapered outer surface extends directly from the upstream end.

14. The packing arrangement of claim 13, wherein the tapered outer surface extends to a cylindrical portion extending between the tapered outer surface and the downstream end.

15. The packing arrangement of claim 13, wherein the tapered outer surface extends to the downstream end.

16. A reciprocating pump, comprising:

a reciprocating element configured to reciprocate during operation of the reciprocating pump to pressurize a fluid; and a junk ring comprising:

an upstream end;

a downstream end disposed opposite of the upstream end; and a tapered outer surface facing away from the reciprocating element and extending between the upstream end and the downstream end, wherein the reciprocating pump defines a packing box, the junk ring is engaged with a surface of the packing box, and the tapered outer surface extends away from the surface of the packing box to form a gap between the tapered outer surface of the junk ring and the surface of the packing box.

17. The reciprocating pump of claim 16, wherein the junk ring comprises an inner surface disposed opposite of the tapered outer surface and engaged with the reciprocating element.

18. The reciprocating pump of claim 16, wherein the upstream end and the downstream end extend parallel to one another.

19. The reciprocating pump of claim 16, wherein the tapered outer surface extends farther away from the upstream end toward the downstream end.

20. The junk ring of claim 1, wherein the junk ring comprises:

an inner surface opposite the tapered outer surface; and chamfered surfaces extending away from the tapered outer surface to the inner surface such that the chamfered surfaces are configured to offset the inner surface toward engagement with a reciprocating element of the reciprocating pump.

* * * * *